US006705603B1

(12) United States Patent
Kirino et al.

(10) Patent No.: US 6,705,603 B1
(45) Date of Patent: Mar. 16, 2004

(54) BINDING APPARATUS

(75) Inventors: Koji Kirino, Kyoto (JP); Takeshi Katoh, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/831,864

(22) PCT Filed: Nov. 18, 1999

(86) PCT No.: PCT/JP99/06460

§ 371 (c)(1),
(2), (4) Date: Jul. 26, 2001

(87) PCT Pub. No.: WO00/30965

PCT Pub. Date: Jun. 2, 2000

(30) Foreign Application Priority Data

Nov. 20, 1998 (JP) ..... 10-330565

(51) Int. Cl.[7] ..... B65H 33/04

(52) U.S. Cl. ..... 270/12; 270/58.08; 270/58.11; 270/52.18; 271/213; 271/303

(58) Field of Search ..... 270/52.18, 58.07, 270/58.08, 58.09, 58.11, 58.12, 58.13, 58.01, 37, 12, 59, 58.02; 271/302–303, 65, 213, 217, 214, 278; 399/298, 410

(56) References Cited

U.S. PATENT DOCUMENTS 5,021,837 A * 6/1991 Uto et al. ..... 270/58.08
5,037,077 A * 8/1991 Kubota ..... 270/58.12
5,215,298 A * 6/1993 Stemmle et al. ..... 271/65
5,344,130 A 9/1994 Suzuki et al.
5,442,432 A * 8/1995 Tani ..... 399/410
5,478,061 A * 12/1995 Murakami et al. ..... 270/58.08
5,497,984 A * 3/1996 Murakami et al. ..... 270/58.02
5,594,542 A * 1/1997 Sugimoto et al. ..... 271/302
5,625,860 A * 4/1997 Maeda et al. ..... 271/298
5,772,197 A * 6/1998 Aoki et al. ..... 270/58.08
5,810,551 A * 9/1998 Yamanaka ..... 270/58.01
5,992,838 A * 11/1999 Saitoh ..... 270/58.09
6,000,894 A * 12/1999 Suzuki et al. ..... 270/52.18
6,102,393 A * 8/2000 Kida et al. ..... 271/303
RE37,197 E * 5/2001 Iida et al. ..... 271/298
6,237,910 B1 * 5/2001 Kawata ..... 271/213
6,263,185 B1 * 7/2001 Kato et al. ..... 271/278
6,332,606 B1 * 12/2001 Seki ..... 270/59
6,357,736 B1 * 3/2002 Kubota et al. ..... 270/58.08
6,374,077 B1 * 4/2002 Hirai et al. ..... 270/58.07

FOREIGN PATENT DOCUMENTS

JP 1-313261 12/1989
JP 7-101619 4/1995

* cited by examiner

*Primary Examiner*—Eugene H. Eickholt
(74) *Attorney, Agent, or Firm*—Dickstein Shapiro Morin & Oshinsky LLP

(57) ABSTRACT

A binding apparatus has a switching flapper 15 switching a feed path for feeding papers to either an upper discharge port or a lower discharge port, a discharge roller 20 provided on the upper discharge port, and a shutter 13, a stapler 14 and a discharge roller 12 provided on the lower discharge port. The discharge roller 12 can feed the papers in a direction opposite to a general paper feed direction, and the shutter 13 stops the papers on a specified position and positions the same when the papers are fed in the opposite direction. The stapler 14 staples the positioned papers. The discharge roller 12 presses the papers against the shutter 13, registers the papers, and discharges the papers in the general paper feed direction after the papers are stapled. Consequently, a miniature paper binding apparatus having a simple structure can be provided.

6 Claims, 18 Drawing Sheets

BINDING APPARATUS

TECHNICAL FIELD

The present invention relates to a binding apparatus, and more particularly, it relates to a binding apparatus for binding papers formed with images in and discharged from an image forming apparatus.

BACKGROUND TECHNIQUE

Binding apparatuses for binding bundles of a plurality of papers discharged from an image forming apparatus such as a copying machine, a printer or a facsimile include an apparatus having a plurality of trays for successively loading bundles of papers to be staled on the trays and stapling the bundles and an apparatus successively storing sheets in a single tray, stapling the sheets and thereafter feeding bundles of the stapled sheets for successively storing the bundles in another tray.

Japanese Patent Publication No. 8-9451 (Japanese Patent Laying-Open No. 1-313261) discloses an apparatus discharging papers to extend over two trays, registering and stapling the papers and thereafter extruding bundles of the stapled papers into the upstream tray for successively storing the same.

The apparatus having a plurality of trays for successively loading bundles of papers to be stapled in the trays and stapling the bundles is complicated in structure and increased in cost due to the large number of trays, and the number of the bundles of sheets processible by this apparatus is disadvantageously restricted to the number of the trays.

The apparatus successively storing sheets in a single tray, stapling the sheets and thereafter feeding bundles of the stapled sheets for successively storing the bundles in another tray requires a mechanism for feeding the bundles of the stapled sheets in addition to the tray for stapling the sheets and the tray for storing the bundles of the sheets, and hence this apparatus is extremely increased in size to require a remarkably high cost.

While the apparatus discharging papers to extend over two trays, registering and stapling the papers and thereafter extruding bundles of the stapled papers into the upstream tray for successively storing the same can be relatively miniaturized, a complicated mechanism is required for extruding the bundles of sheets into the upstream tray.

The present invention has been proposed in consideration of the aforementioned circumstances, and an object thereof is to provide a miniature binding apparatus which can staple a bundle of papers with a simple structure.

DISCLOSURE OF THE INVENTION

The binding apparatus according to the present invention comprises first discharge means for discharging a single or plurality of first papers, positioning means for stopping the single or plurality of first papers and a second paper on a specified position and positioning the single or plurality of first papers and the second paper, binding means for binding the single or plurality of first papers and the second paper as positioned, second discharge means located under the first discharge means for discharging the second paper and thereafter pressing the second paper against the positioning means while pressing the single or plurality of first papers discharged by the first discharge means against the positioning means and discharging the single or plurality of first papers and the second paper after the single or plurality of first papers and the second paper are bound by the binding means, and switching means for switching a path for feeding the single or plurality of first papers or the second paper toward either the first discharge means or the second discharge means.

In the binding apparatus according to the present invention, the first discharge means discharges a single or plurality of first papers, the positioning means stops the single or plurality of first papers and a second paper on a specified position and positions the single or plurality of first papers and the second paper, the binding means binds the single or plurality of first papers and the second paper as positioned, the second discharge means is located under the first discharge means for discharging the second paper and thereafter pressing the second paper against the positioning means while pressing the single or plurality of first papers discharged by the first discharge means against the positioning means and discharging the single or plurality of first papers and the second paper after the single or plurality of first papers and the second paper are bound by the binding means, and the switching means switches a path for feeding the single or plurality of first papers or the second paper toward either the first discharge means or the second discharge means.

BEST MODES FOR CARRYING OUT THE INVENTION

Figure 1:
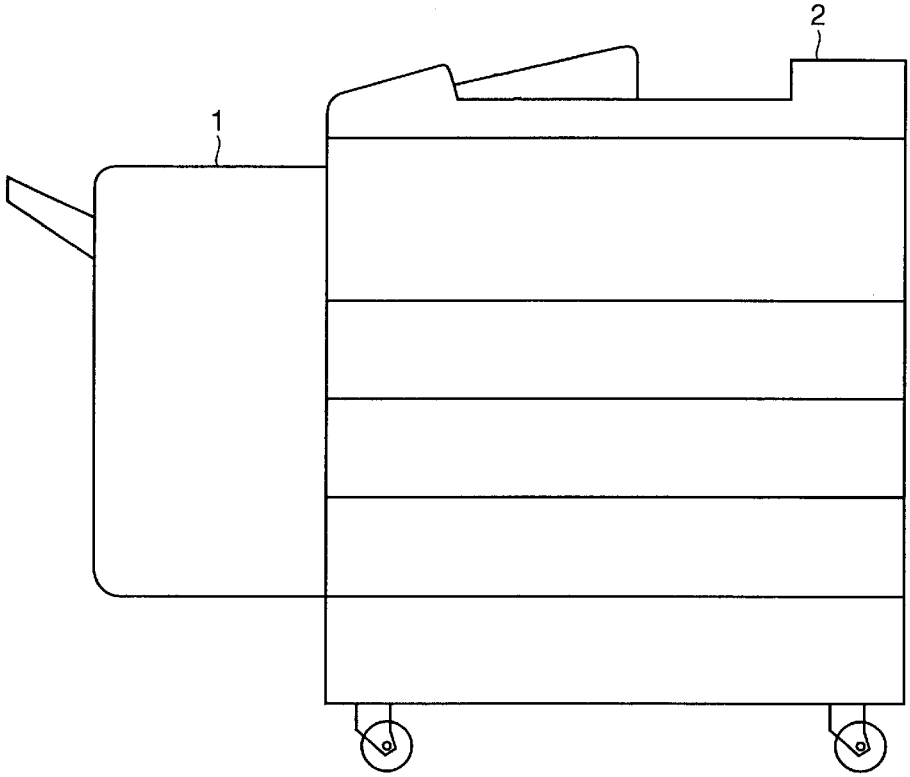
FIG. 1 illustrates the appearance of a binding apparatus 1 according to the present invention.

While embodiments of the present invention are now described, the features of the present invention are described as follows with the corresponding embodiment (only one) in parenthesis succeeding each means, in order to clarify the correspondence between each means of the invention described in the scope of claim for patent and the embodiments described below. However, this description is of course not intended to restrict each means to the described one.

The binding apparatus according to the present invention comprises a first discharge unit (for example, discharge rollers 20 shown in FIG. 2) discharging a single or plurality of first papers, a positioner (for example, a shutter 13 shown in FIG. 2) stopping the single or plurality of first papers and a second paper on a specified position and positioning the single or plurality of first papers and the second paper, a binder (for example, a staple 14 shown in FIG. 2) binding the single or plurality of first papers and the second paper as positioned, a second discharge unit (for example, discharge rollers 12 shown in FIG. 2) located under the first discharge unit for discharging the second paper and thereafter pressing the second paper against the positioner while pressing the single or plurality of first papers discharged by the first discharge unit against the positioner and discharging the single or plurality of first papers and the second paper after the single or plurality of first papers and the second paper are bound by the binder, and a switcher (for example, a switching flapper 15 shown in FIG. 2) switching a path for feeding the single or plurality of first papers or the second paper toward either the first discharge unit or the second discharge unit.

Referring to FIG. 1, the binding apparatus 1 according to the present invention is mounted on a discharge port of a printing apparatus 2 discharging printed papers 3 for stapling a prescribed bundle of the papers 3.

Figure 2:
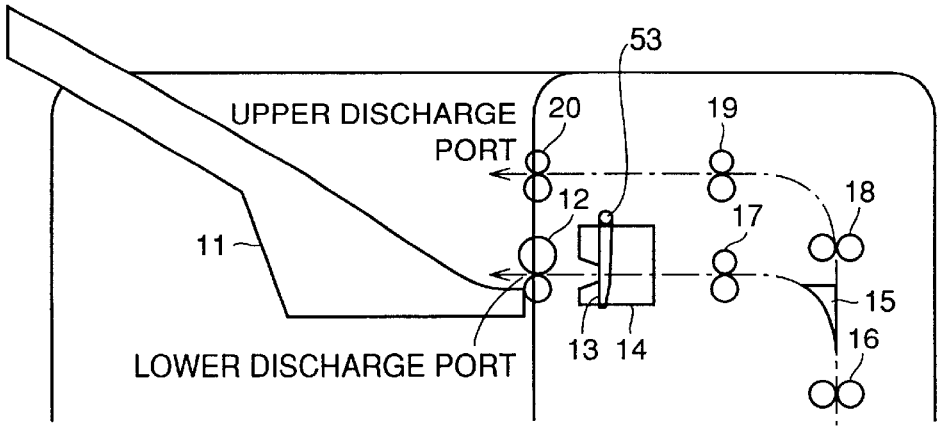
FIG. 2 illustrates the structure of an embodiment of the binding apparatus 1 according to the present invention.

Referring to FIG. 2, a tray 11 vertically moves in FIG. 2 so that the bundle of the papers 3 stapled by the binding apparatus 1 is loaded thereon.

Figure 9:
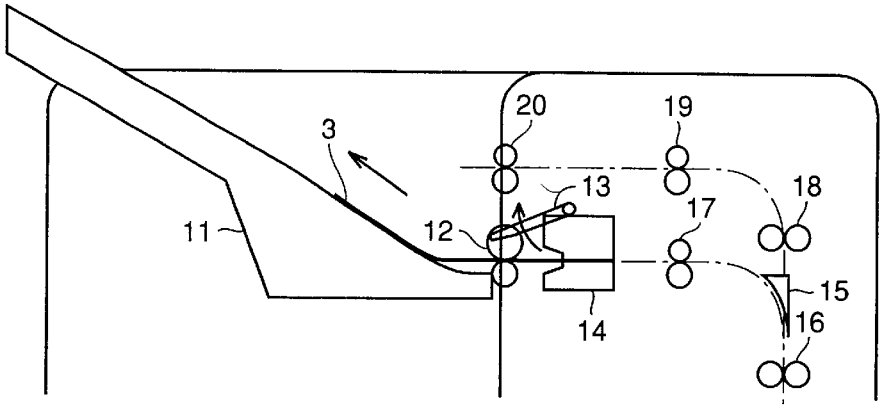
FIG. 9 is a diagram illustrating operation of the shutter 13.
Figure 10:
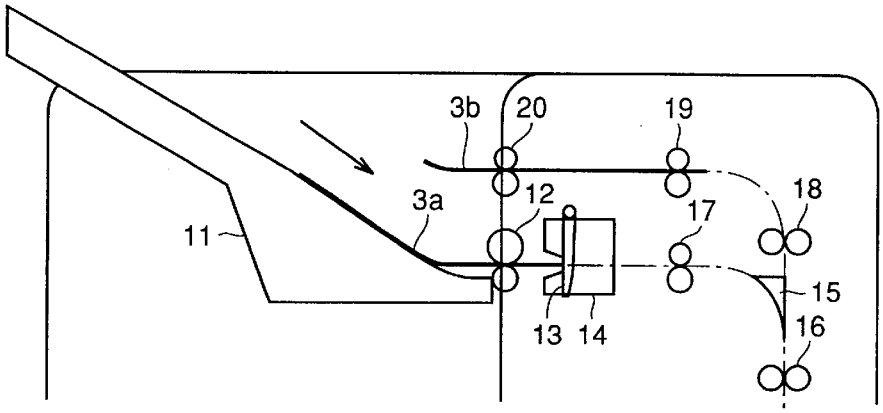
FIG. 10 is a diagram illustrating the operation of the shutter 13.

Discharge rollers 12 normally rotate (the upper one of the discharge rollers 12 rotates clockwise in FIG. 2) for discharging a paper 3 shown in FIG. 9 fed through a feed path on the lower side in FIG. 2 from a lower discharge port up to an intermediate portion of the paper 3, reversely rotate as shown in FIG. 10 (the upper one of the discharge rollers 12 rotates counterclockwise in FIG. 2) after a shutter 13 returns to a specified position for drawing the paper 3 into the binding apparatus 1, and presses the paper 3 against the shutter 13. When reversely rotating, the discharge rollers 12 draw a paper 3 discharged from an upper discharge port into the binding apparatus 1 while sliding this paper 3 on the paper 3 held between the discharge rollers 12, and press the same against the shutter 13 for registering the papers 3. After a bundle of the papers 3 is stapled, the discharge rollers 12 normally rotate for discharging the bundle of the stapled papers 3 onto the tray 11.

Figure 8:
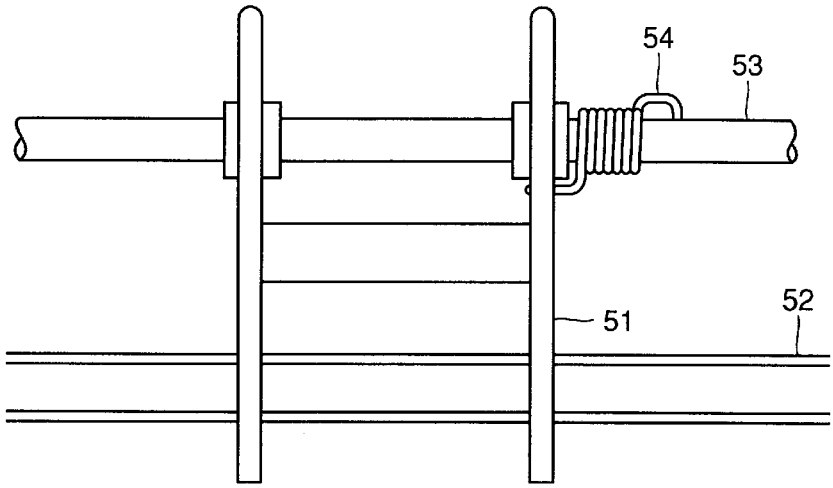
FIG. 8 illustrates the structure of a shutter 13.

As described later with reference to FIG. 8, the shutter 13 is urged counterclockwise in FIG. 2 about a shaft 53 provided on an upper portion of the shutter 13, to be pressed against a specified position of the body of the stapler 14 and stop when no paper 3 is fed through the feed path on the lower side in FIG. 2 and passed through the shutter 13. When the discharge rollers 12 reversely rotate for registering the bundle of the papers 3, the bundle of the papers 3 is pressed against the shutter 13. When a paper 3 is fed through the feed path on the lower side in FIG. 2, this paper 3 rotates the shutter 13 about the shaft provided on the upper portion thereof clockwise in FIG. 2 at a prescribed angle against the urging force of a spring (not shown), and is discharged from the lower discharge port.

The stapler 14 staples and binds a bundle of a prescribed number of papers 3 pressed against the shutter 13 and registered due to the reverse rotation of the discharge rollers 12. A switching flapper 15 switches the feed path to feed a paper 3 fed by feed rollers 16 to either feed rollers 17 or feed rollers 18. The feed rollers 16, the feed rollers 17, the feed rollers 18 and feed rollers 19 hold the paper 3 and rotate for feeding the paper 3 to be discharged from the upper discharge port or the lower discharge port. An upper one of discharge rollers 20 rotates clockwise in FIG. 2 for discharging the paper 3 (second or subsequent paper 3 to be stapled) fed by the feed rollers 19 from the upper discharge port.

Figure 3:
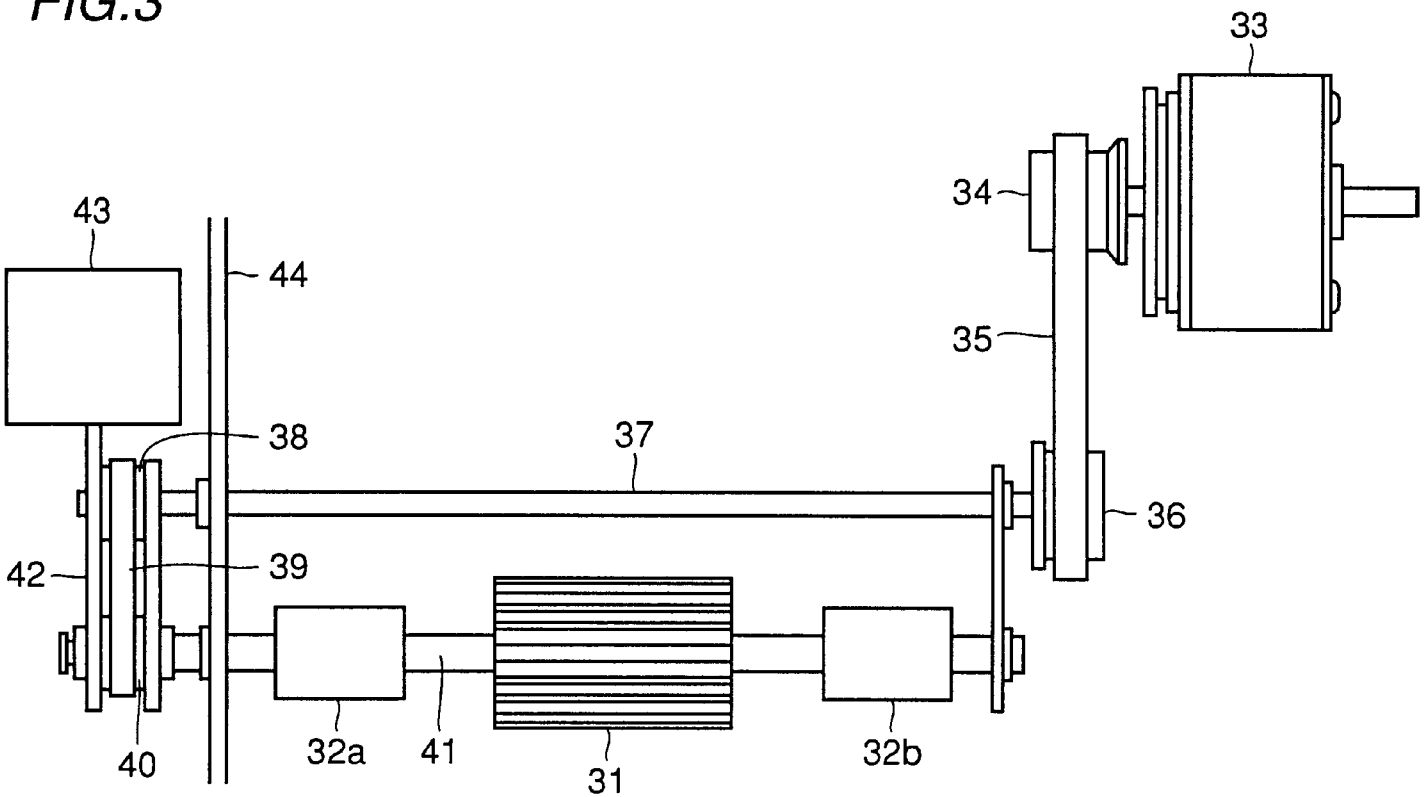
FIG. 3 illustrates the structure of discharge rollers 12.

The structure of the discharge rollers 12 is now described with reference to FIG. 3. A roller 31 made of sponge is provided on its surface with projections for adjusting frictional force between the roller 31 and the paper 3 to be capable of holding a warped paper 3. The roller 31 transmits torque not exceeding a prescribed value to the paper 3 as feeding force. As described later with reference to FIG. 6, the roller 31 is formed to be deformed when rollers 32*a* and 32*b* come into contact with the paper 3, not to inhibit this contact. The rollers 32*a* and 32*b* (the rollers 32*a* and 32*b* are hereinafter simply referred to as rollers 32 when the same may not be distinctively described independently of each other) are smaller in outer diameter than the roller 31.

When a shaft of a motor 33 rotates, a pulley 34 mounted on the shaft of the motor 33 rotates to transmit the torque of the shaft of the motor 33 to a pulley 36 through a belt 35. The pulley 36 is fixed to an end of a shaft 37, while a pulley 38 is fixed to another end of the shaft 37. The shaft 37 is rotatably fixed to a frame 44 and an arm 42. Therefore, the torque transmitted to the pulley 36 rotates the pulley 38.

A pulley 40 is fixed to a shaft 41, which is rotatably mounted on the arm 42 and the frame 44. The torque transmitted to the pulley 38 is transmitted to the pulley 40 through a belt 39, to rotate the roller 31 as well as the rollers 32*a* and 32*b* through the shaft 41.

A solenoid 43 rotates the arm 42 about the shaft 37 within a prescribed angle range.

Figure 4:
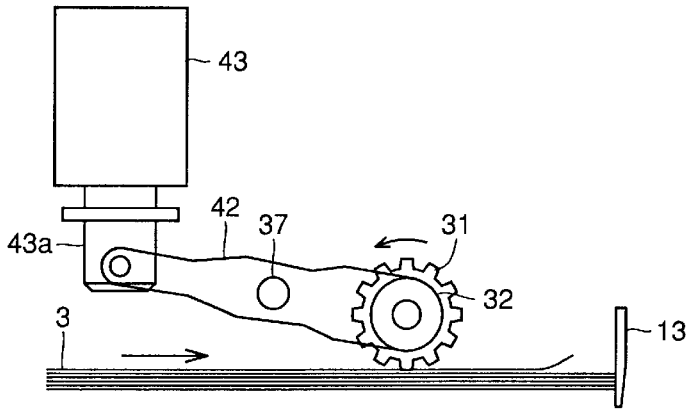
FIG. 4 illustrates operation of the discharge rollers 12.
Figure 5:
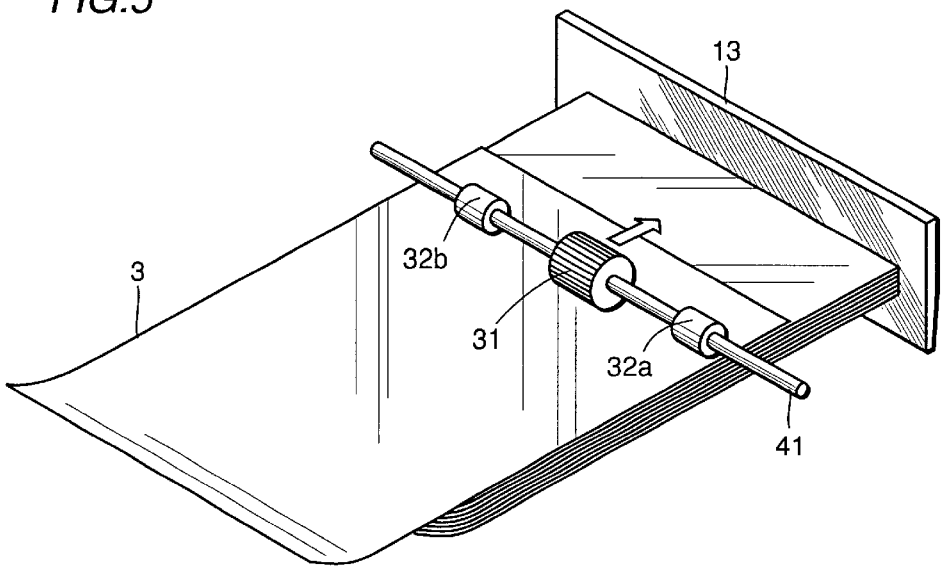
FIG. 5 illustrates the operation of the discharge rollers 12.

Operation of the discharge rollers 12 driven by the solenoid 43 is now described. FIGS. 4 and 5 are diagrams for illustrating the operation of the discharge rollers 12 reversely rotating for registering the bundle of the papers 3. The solenoid 43 is turned off to free a plunger 43*a*. The arm 42 freely rotates about the shaft 37 within the specified angle range so that the surface of the roller 31 comes into contact with the uppermost paper 3. At this time, the rollers 32 are not in contact with the paper 3. The roller 31 rotates counterclockwise in FIG. 4, for moving the paper 3 rightward in FIG. 4 and pressing the same against the shutter 13. After the paper 3 is pressed against the shutter 13, the rotating roller 31 slides on the paper 3.

Figure 6:
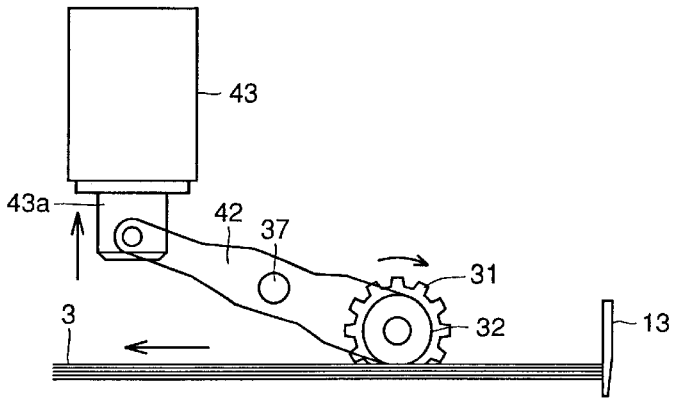
FIG. 6 illustrates the operation of the discharge rollers 12.
Figure 7:
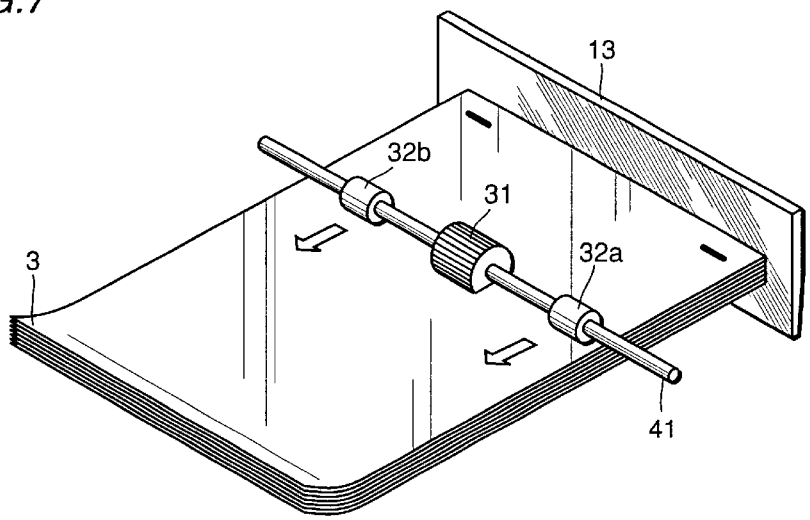
FIG. 7 illustrates the operation of the discharge rollers 12.

FIGS. 6 and 7 are diagrams for illustrating the operation of the discharge rollers 12 normally rotating for discharging the bundle of the stapled papers 3. The solenoid 43 is turned on to move the plunger 43*a* toward the body of the solenoid 43. The arm 42 rotates about the shaft 37 clockwise in FIG. 6, so that the surfaces of the rollers 32 come into contact with the uppermost paper 3. At this time, the roller 31 is so deformed that the rollers 32 can be in contact with the paper 3. The rollers 32 rotate clockwise in FIG. 6, for moving the bundle of the stapled papers 3 leftward in FIG. 6 and discharging the same.

The shutter 13 is now described with reference to FIG. 8. A shutter frame 51 (corresponding to the shutter 13 shown in FIG. 2) rotates about the shaft 53 fixed to the body of the binding apparatus 1. The shutter frame 51 is urged by a spring 54 to be pressed against part of the body of the stapler 14 and stop on the specified position. A bundle (not shown) of the papers 3 held by a feed guide 52 and pressed against the shutter frame 51 stops on a specified position with respect to the stapler 14 (not shown).

FIG. 9 is a diagram for illustrating operation of the shutter 13 carried out when the feed rollers 17 and the discharge rollers 12 discharge the first paper 3 for the bundle of the papers 3 to be stapled from the lower discharge port. The paper 3 fed by the feed rollers 17 rotates the shutter frame 51 about the shaft 53 clockwise in FIG. 9 against the urging force of the spring 54 with the force (feeding force) transmitted from the feed rollers 17. The paper 3 reaches the discharge rollers 12 while rotating the shutter frame 51, to be fed by the discharge rollers 12 and discharged from the lower discharge port.

FIG. 10 is a diagram for illustrating the operation of the shutter 13 carried out when the bundle of the papers 3 is registered. The shutter frame 51 is urged by the spring 54 to be pressed against part of the body of the stapler 14 and stop on the specified position. The discharge rollers 12 reversely rotate (the roller 31 rotates counterclockwise in FIG. 10) for pressing a paper 3*a* held between the discharge rollers 12 against the shutter 13. When the discharge rollers 12 reversely rotate to press the paper 3*a* against the shutter 13, the force applied to the shutter 13 acts in the same direction (for rotating the shutter 13 counterclockwise in FIG. 10) as the urging force of the spring 54, not to further rotate the shutter 13. A paper 3*b* discharged from the upper discharge port slides on the paper 3*a* on the tray 11, and is drawn into the binding apparatus 1 by the discharge rollers 12, pressed against the shutter 13 and registered with the paper 3*a*.

Figure 11:
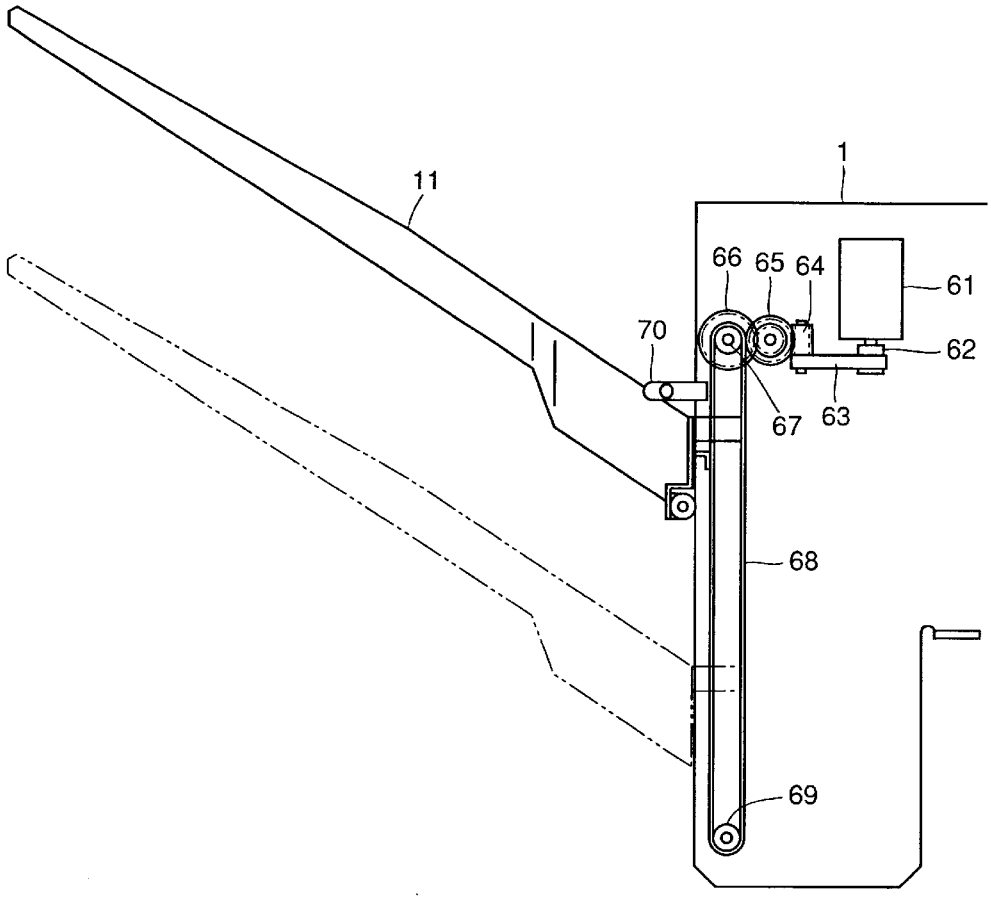
FIG. 11 is a front elevational view illustrating a mechanism for vertically moving a tray 11.
Figure 12:
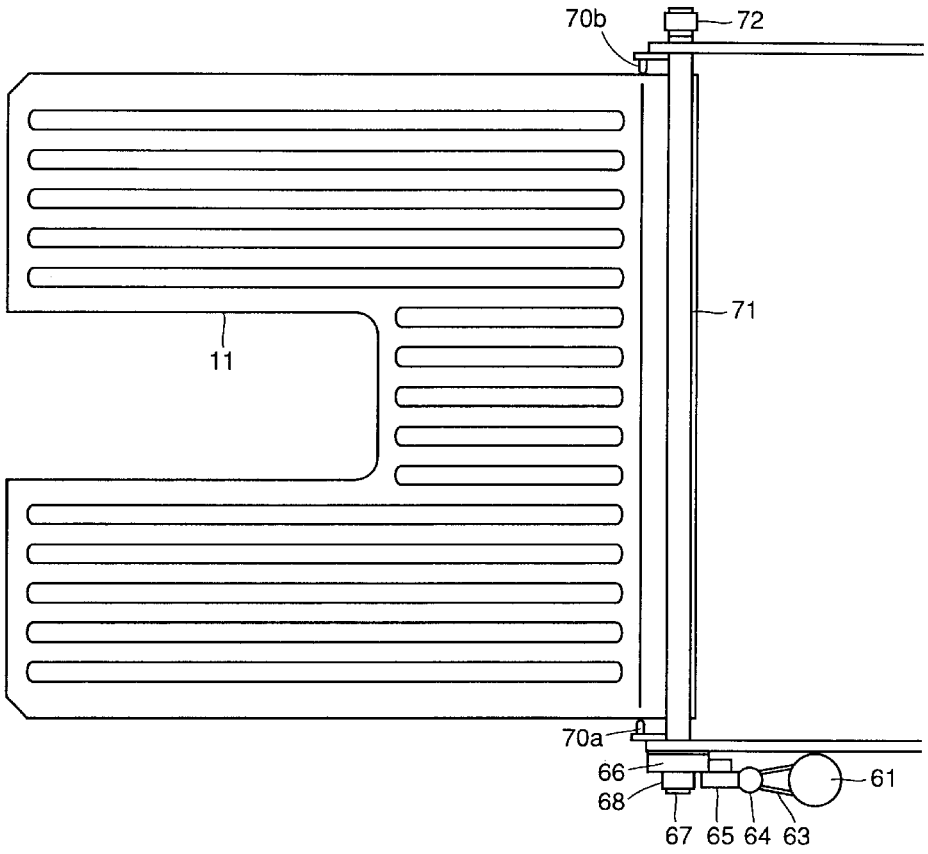
FIG. 12 is a top plan view illustrating the mechanism for vertically moving the tray 11.

FIG. 11 is a front elevational view for illustrating a mechanism for vertically moving the tray 11. FIG. 12 is a top plan view for illustrating the mechanism for vertically moving the tray 11. When a shaft of a motor 61 rotates, a pulley 62 fixed to the shaft of the motor 61 rotates for transmitting the torque of the motor 61 to a gear 66 through a belt 63, a gear 64 and a gear 65. A pulley 67 is fixed to an end of a shaft 71 along with the gear 66, while the shaft 71 is rotatably fixed to the binding apparatus 1. A pulley 69 is rotatably fixed to the binding apparatus 1. A belt 68 extended along the pulley 67 and the pulley 69 is partially fixed to the tray 11. A pulley is fixed to another end of the shaft 71, and a belt 72 is extended along this pulley. The belt 72 is partially fixed to a specified portion of the tray 11. The tray 11 is fixed to a rail (not shown) to be only vertically movable in FIG. 11. When the shaft 71 and the pulley 67 rotate due to the rotation of the shaft of the motor 61, the belt 68 and the belt 72 so rotate that the tray 11 vertically moves in FIG. 11 following the rotation of the belt 68 and the belt 72.

Photoelectric switches 70*a* and 70*b* are shielding type switches, which output prescribed signals when the bundle of the papers 3 intercepts the optical axis connecting the photoelectric switches 70*a* and 70*b*. On the basis of these signals, the binding apparatus 1 can vertically move the tray 11 and control the same so that the upper surface of the bundle of the papers 3 loaded on the tray 11 is located on the uppermost position not intercepting the optical axis connecting the photoelectric switches 70*a* and 70*b*, i.e., a specified position with respect to the discharge rollers 12.

Figure 13:
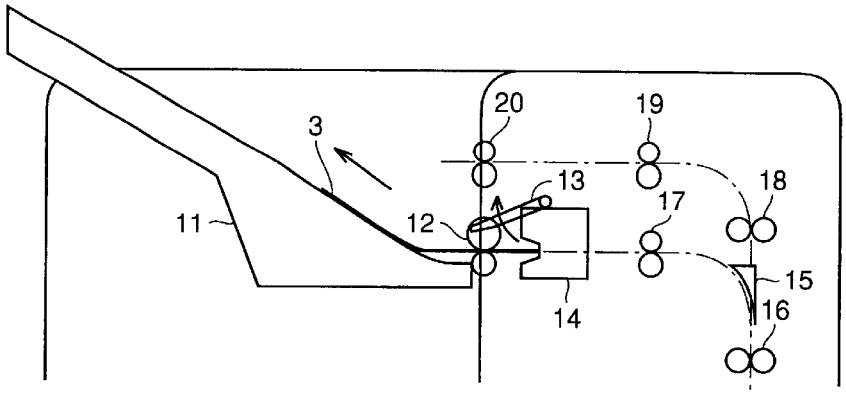
FIG. 13 is a diagram illustrating operation of the binding apparatus 1.

The operation of the binding apparatus 1 is now described with reference to FIGS. 13 to 16. When discharging the first paper 3 to be stapled as shown in FIG. 13, the binding apparatus 1 rotates the switching flapper 15 counterclockwise in FIG. 13 for feeding the first paper 3 fed by the feed rollers 16 to the feed rollers 17. The first paper 3 held between the feed rollers 17 rotates the shutter frame 51 clockwise in FIG. 13, and reaches the discharge rollers 12. The discharge rollers 12 discharge the first paper 3 to a position enabling the shutter frame 51 of the shutter 13 to return to the original position while partially holding the first paper 3, and the binding apparatus 1 thereafter reversely rotates the discharge rollers 12 while keeping the solenoid 43 off as shown in FIG. 4, for pressing the held paper 3 against the shutter frame 51 of the shutter 13 returning to the original position. After the paper 3 is pressed against the shutter frame 51, the rotating roller 31 of the discharge rollers 12 slides on the paper 3, so that the paper 3 stops on the position where the same is pressed against the shutter frame 51.

Figure 14:
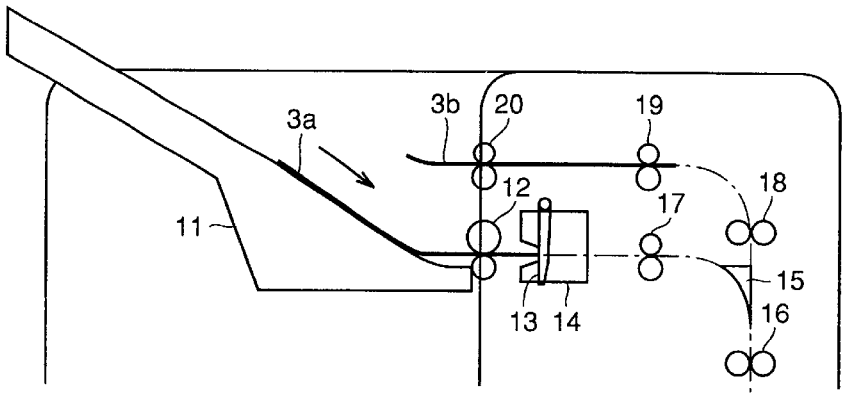
FIG. 14 is a diagram illustrating the operation of the binding apparatus 1.
Figure 15:
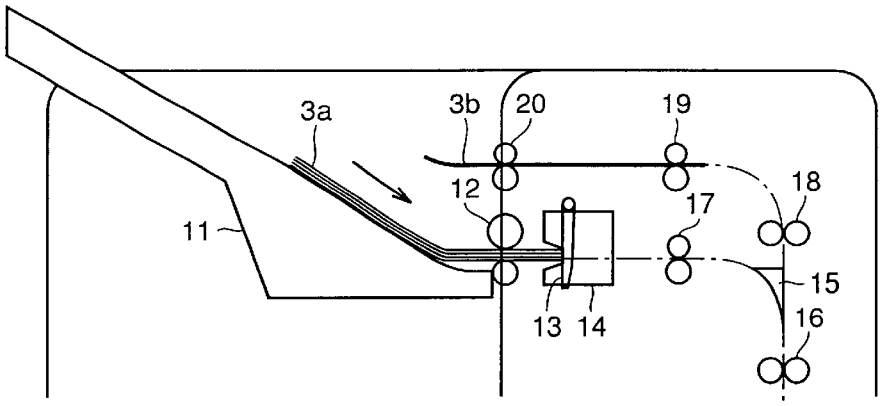
FIG. 15 is a diagram illustrating the operation of the binding apparatus 1.

Then, the binding apparatus 1 rotates the switching flapper 15 clockwise in FIGS. 14 and 15 for feeding a second or subsequent paper 3*b* with the feed rollers 16, the feed rollers 18, the feed rollers 19 and the discharge rollers 20, discharging the paper 3*b* from the upper discharge port and loading the same on the paper 3*a* on the tray 11, as shown in FIGS. 14 and 15. The paper 3*b* loaded on the paper 3*a* slides on the paper 3*a*, and is moved rightward in FIGS. 14 and 15, drawn into the binding apparatus 1 again and pressed against the shutter frame 51 of the shutter 13 by the reversely rotating discharge rollers 12. After the paper 3*b* is pressed against the shutter frame 51, the rotating roller 31 of the discharge rollers 12 slides on the paper 3*b* similarly to the case shown in FIG. 13, so that the paper 3*b* stops on the position where the same is pressed against the shutter frame 51 and is registered with the paper 3*a*.

Figure 16:
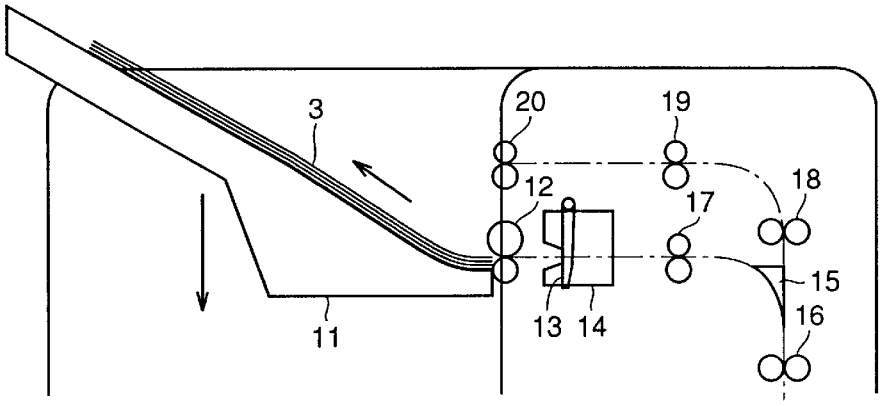
FIG. 16 is a diagram illustrating the operation of the binding apparatus 1.

When the registered papers 3 reach a prescribed number, the binding apparatus 1 staples the bundle of the papers 3 with the stapler 14. Thereafter the binding apparatus 1 turns on the solenoid 43, presses the rollers 32 against the papers 3 and normally rotates the discharge rollers 12 as shown in FIG. 6, for discharging the bundle of the stapled papers 3 onto the tray 1 as shown in FIG. 16. The binding apparatus 1 moves the tray 11 downward in FIG. 16 so that the bundle of the papers 3 discharged onto the tray 11 does not intercept the optical axis between the photoelectric switches 70. The upper surface of the bundle of the papers 3 discharged onto the tray 11 moves down to a specified position with respect to the discharge rollers 12, so that a next paper is discharged from the lower discharge port with no interception by the bundle of the papers 3 loaded on the tray 11.

As hereinabove described, the binding apparatus 1 staples the bundle of the papers 3 and discharges the same onto the tray 11.

Figure 17:
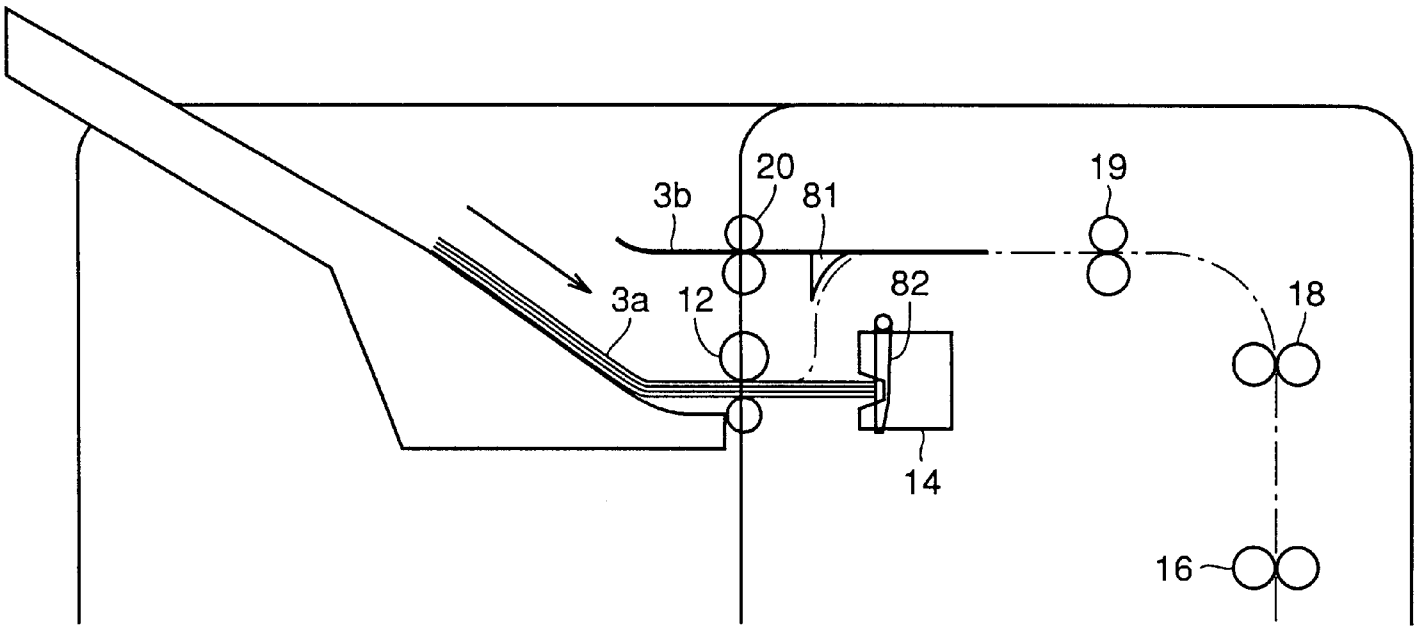
FIG. 17 illustrates the structure of another embodiment of the binding apparatus 1 according to the present invention.

FIG. 17 illustrates another embodiment of the binding apparatus 1. Parts similar to those shown in FIG. 2 are denoted by the same reference numerals, and redundant description is not repeated. A switching flapper 81 is located between feed rollers 19 and discharge rollers 20. When the switching flapper 81 rotates counterclockwise in FIG. 17, a paper 3*a* fed by the feed rollers 19 is fed to discharge rollers 12 without passing through a shutter 82. The shutter 82 remains unrotating. When the switching flapper 81 rotates clockwise in FIG. 17, a paper 3*b* fed by the feed rollers 19 is fed to the discharge rollers 20.

According to the structure shown in FIG. 17, the feed rollers 17 can be omitted and the shutter 82 may not be formed to rotate so that the binding apparatus 1 can be more simplified in structure as compared with that shown in FIG. 2.

Figure 18:
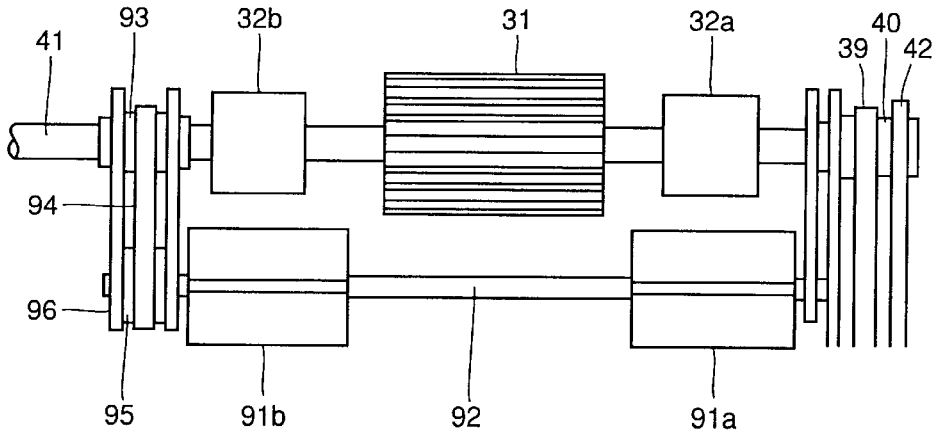
FIG. 18 illustrates another structure of the discharge rollers 12.
Figure 19:
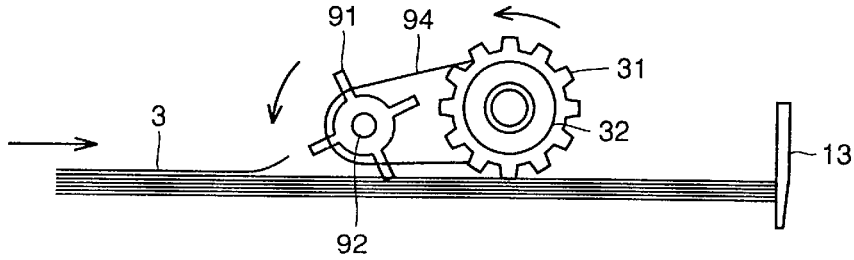
FIG. 19 illustrates operation of the discharge rollers 12.

FIG. 18 is a bottom plan view of discharge rollers 12 more improved in force for registering papers 3, and FIG. 19 is a side elevational view of the discharge rollers 12. Parts similar to those shown in FIG. 3 are denoted by the same reference numerals, and redundant description is not repeated. Each of rollers 91*a* and 91*b* is provided with four paddles and fixed to a shaft 92, as shown in FIGS. 18 and 19. The shaft 92 is rotatably fixed to an arm 96. The torque of a shaft 41 is transmitted to the shaft 92 through a pulley 93 fixed to the shaft 41, a belt 94 and a pulley 95. Therefore, the rollers 91*a* and 91*b* rotate in the same direction as a roller 31.

The rollers 91*a* and 91*b* having the puddles can reliably draw a paper 3 into the binding apparatus 1 also when the paper 3 is warped, as shown in FIG. 19.

Figure 20:
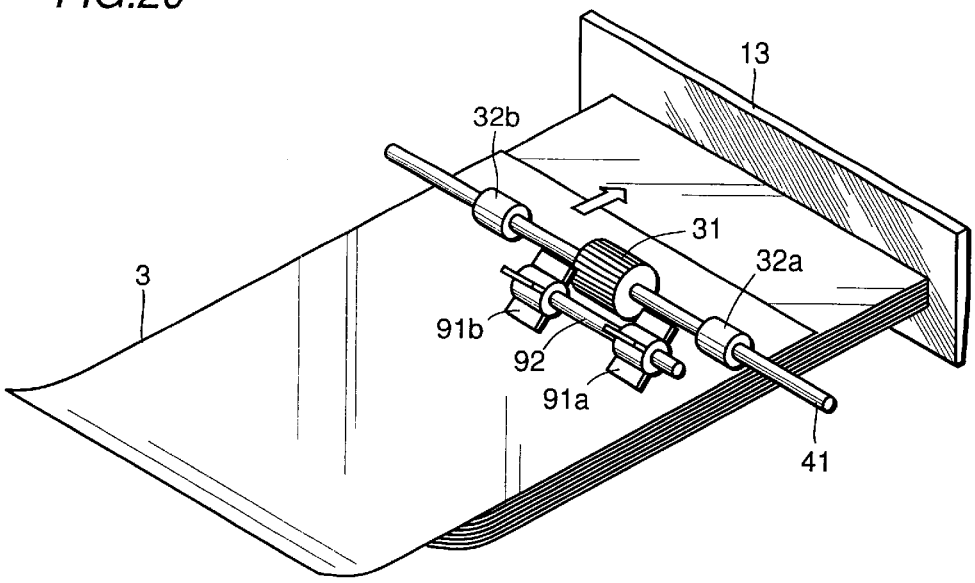
FIG. 20 illustrates the operation of the discharge rollers 12.

FIG. 20 is a perspective view of the discharge rollers 12 more improved in the force for registering the papers 3. Ends of the paper 3 drawn by the rollers 91*a* and 91*b* are pressed downward in FIG. 20, so that the paper 3 is reliably held by the roller 31 and registered with other papers 3.

Therefore, the binding apparatus 1 having the discharge rollers 12 shown in FIGS. 18 and 19 more reliably registers the papers 3.

Figure 21:
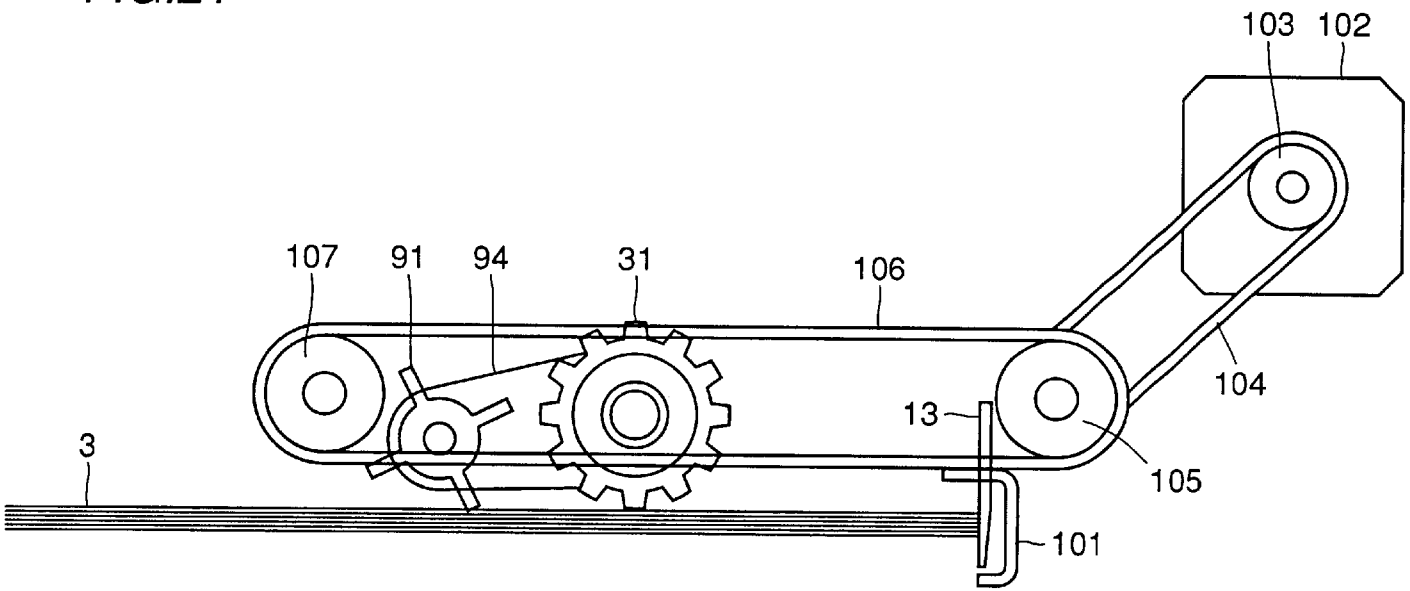
FIG. 21 illustrates the structure of a discharge mechanism of the binding apparatus 1 discharging a bundle of papers 3 with a hook.
Figure 22:
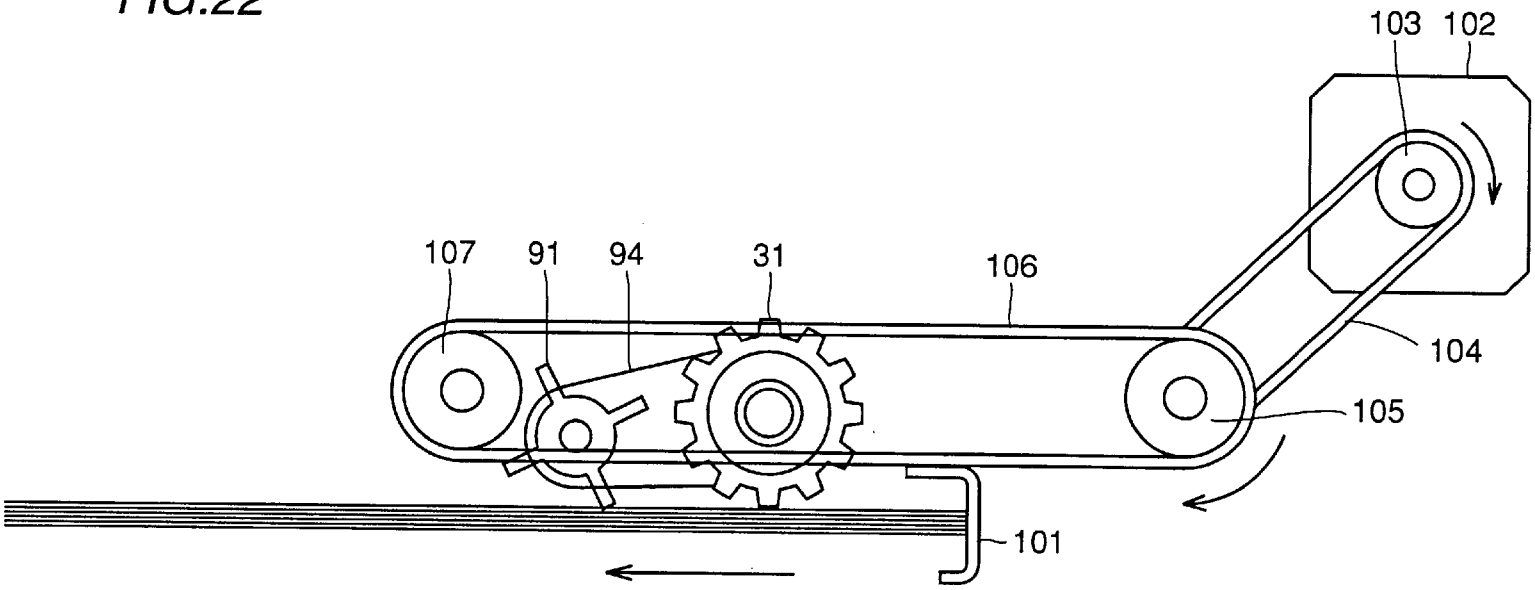
FIG. 22 illustrates operation of the discharge mechanism of the binding apparatus 1 discharging the bundle of the papers 3 with the hook.

FIG. 21 illustrates the structure of a discharge mechanism of the binding apparatus 1 for discharging a bundle of papers 3 as stapled with a hook. FIG. 22 illustrates a state in an intermediate stage of the discharge operation of the binding apparatus 1 discharging the bundle of the papers 3 with the hook. Discharge rollers 12 of the binding apparatus 1 shown in FIG. 21, having a roller 31 of sponge and rollers 91 provided with paddles, has neither rollers 32 of rubber nor a mechanism such as the solenoid 43 pressing the rollers 32 against papers.

When the binding apparatus 1 rotates the roller 31 of sponge and the rollers 91 provided with paddles for registering the bundle of the papers 3, the hook 101 is located rightward beyond the shutter 13 as shown in FIG. 21, and not in contact with the bundle of the registered papers 3. After the bundle of the registered papers 3 is stapled, a shaft of a motor 102 rotates clockwise, as shown in FIG. 22. Following the rotation of the shaft o the motor 102, the hook 101 moves leftward in FIG. 22 for pressing an end of the bundle of the papers 3 and discharging the bundle of the papers 3. After the bundle of the papers 3 is discharged onto the tray 11, the shaft of the motor 102 is rotated counterclockwise in FIG. 22, for returning the hook 101 to the position shown in FIG. 21.

Thus, the binding apparatus 1 shown in FIGS. 21 and 22 more reliably discharges the bundle of the papers 3.

Figure 23:
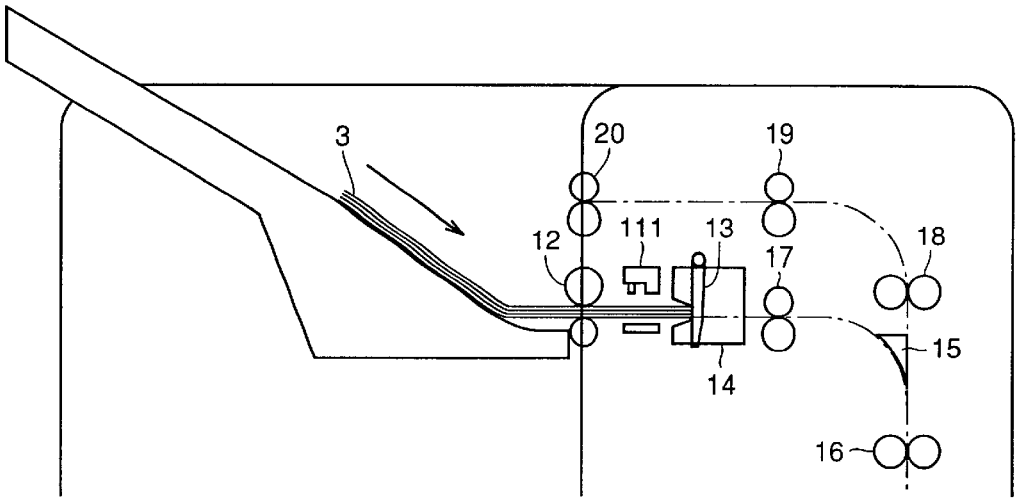
FIG. 23 illustrates the structure of still another embodiment of the binding apparatus 1 according to the present invention.

FIG. 23 is a diagram for illustrating a structure of the binding apparatus 1 having a punching mechanism. Parts similar to those shown in FIG. 2 are denoted by the same reference numerals, and redundant description is not repeated. A punch unit 111 is fixed to a position not hindering the operation of the shutter 13 and the stapler 14, for punching specified positions of a bundle of stapled or only registered papers 3 in a prescribed case. When the punch unit 111 punches the bundle of only registered papers 3, the binding apparatus 1 discharges the bundle of the papers 3 through the discharge mechanism shown in FIGS. 21 and 22.

Figure 24:
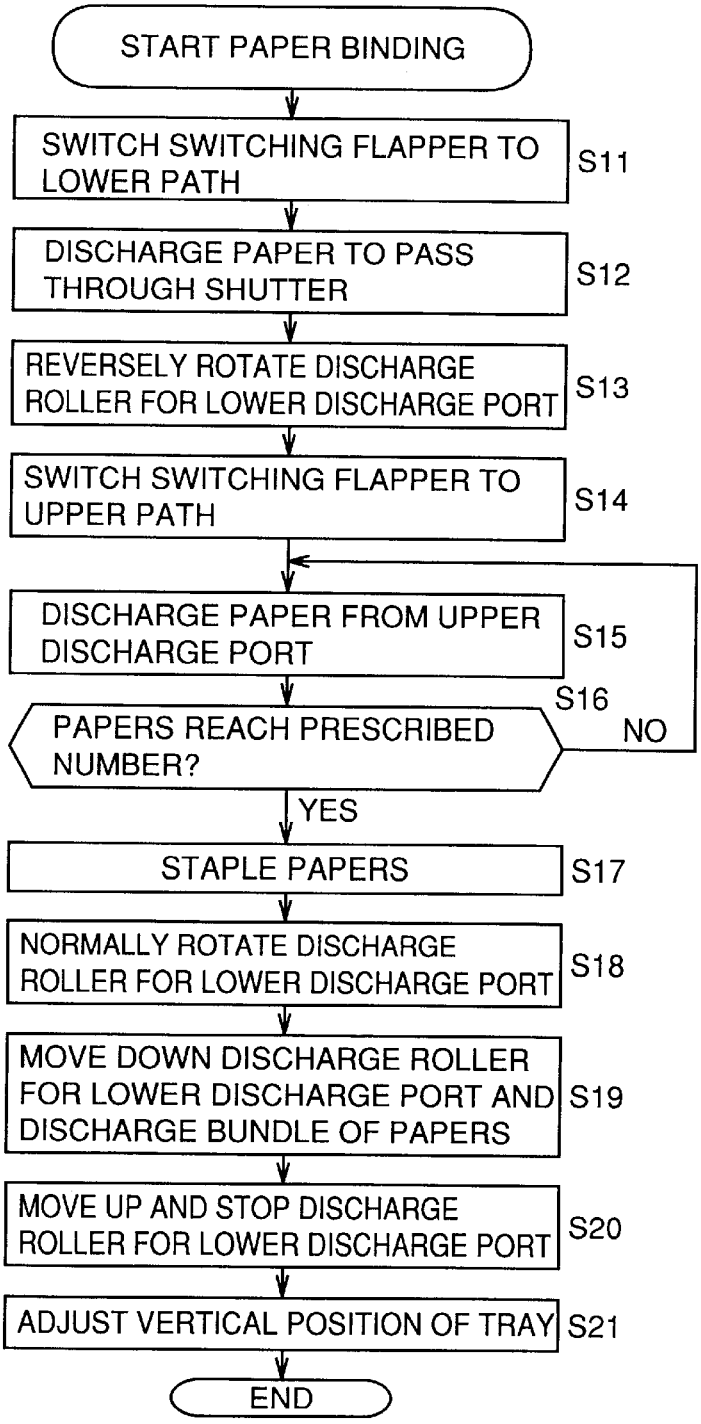
FIG. 24 is a flow chart illustrating processing of the binding apparatus 1 for binding the bundle of the papers 3.

Processing of the binding apparatus 1 for binding the bundle of the papers 3 is now described with reference to a flow chart shown in FIG. 24. At a step S11, the binding apparatus 1 rotates the switching flapper 15 counterclockwise in FIG. 2, for switching the path for feeding the paper 3 to that leading to the lower discharge port. At a step S12, the discharge rollers 17 of the binding apparatus 1 feed the paper 3 until the paper 3 rotates the shutter 13 clockwise in FIG. 2 and thereafter reaches the discharge rollers 12. The discharge rollers 12 feed the paper 3 leftward in FIG. 2 until an end of the paper 3 separates from the shutter 13 and the shutter 13 rotates counterclockwise and returns to the original position (the position shown in FIG. 2) due to the urging force of the spring 54. At a step S13, the binding apparatus 1 reversely rotates the discharge rollers 12 while keeping the solenoid 43 off, for pressing the paper 13 against the shutter 13.

At a step S14, the binding apparatus 1 rotates the switching flapper clockwise in FIG. 2, for switching the path for feeding the paper 3 to that leading to the upper discharge port. The step S14 may be carried out in advance of the step S13. At a step S15, the binding apparatus 1 rotates the feed rollers 18, the feed rollers 19 and the discharge rollers 20, for discharging the next paper 3 from the upper discharge port. The paper 3 discharged from the upper discharge port is drawn by the reversely rotating discharge rollers 12 while sliding on the paper 3 already loaded on the tray 11, to be pressed against the shutter 13 and registered with the paper 3 already loaded on the tray 11.

At a step S16, the binding apparatus 1 determines whether or not the discharged papers 3 have reached a prescribed number, to return to the step S15 and continuously discharge the paper 3 when determining that the discharge papers 3 have not yet reached the prescribed number.

When the binding apparatus 1 determines that the discharged papers 3 have reached the prescribed number at the step S16, the process advances to a step S17 so that the stapler 14 of the binding apparatus 1 staples the bundle of the registered papers 3. At a step S18, the binding apparatus 1 normally rotates the discharge rollers 12. At a step S19, the binding apparatus 1 turns on the solenoid 43 for pressing the rollers 32 against the bundle of the papers 3 as shown in FIG. 6, and discharging the bundle of the papers 3. At a step S20, the binding apparatus 1 discharges the bundle of the papers 3 onto the tray 11, thereafter turns off the solenoid 43, moves up the rollers 32 as shown in FIG. 4, and stops rotating the discharge rollers 12. At a step S21, the binding apparatus 1 moves down the tray 11 to the position where the bundle of the papers 3 loaded on the tray 11 does not intercept the optical axis between the photoelectric switches 70, and terminates the processing.

As hereinabove described, the binding apparatus 1 binds the bundle of the prescribed number of papers 3 and loads the bundle of the papers 3 on the tray 11.

INDUSTRIAL AVAILABILITY the binding apparatus according to the present invention, which can staple a bundle of papers with a simple structure and a small size, is suitably applied to a stapling apparatus serving as a post-processor for various types of papers.

What is claimed is:

1. A binding apparatus comprising:

first discharge means for discharging a single or plurality of first papers:

positioning means for stopping said single or plurality of first papers and a second paper on a specified position and positioning said single or plurality of first papers and said second paper;

binding means for binding said single or plurality of first papers and said second paper positioned on said position;

second discharge means located under said first discharge means for discharging said second paper and thereafter pressing said second paper against said positioning means while pressing said single or plurality of first papers discharged by said first discharge means against said positioning means and discharging said single or plurality of first papers and said second paper after said single or plurality of first papers and said second paper are pressed by said pressing means; and switching means for switching a path for feeding said single or plurality of first papers or said second paper toward either said first discharge means or said second discharge means.

2. The binding apparatus according to claim 1, wherein said second discharge means changes feeding force for said single or plurality of first papers and said second paper when pressing said single or plurality of first papers and said second paper against said positioning means and when discharging said single or plurality of first papers and said second paper bound by said binding means.

3. The binding apparatus according to claim 1, wherein said second discharge means feeds said single or plurality of first papers and said second paper by pressing ends of said single or plurality of first papers and said second paper when discharging said bound single or plurality of first papers and said second paper.

4. The binding apparatus according to claim 1, wherein said second discharge means has a roller provided with a projection substantially perpendicular to the circumference thereof.

5. The binding apparatus according to claim 1, wherein said positioning means makes said second paper pass when said second paper is discharged.

6. The binding apparatus according to claim 1, further comprising punching means for punching a hole on a specified position of said positioned single or plurality of papers and said second paper.

* * * * *